US008523609B2

(12) United States Patent
Roman, Jr.

(10) Patent No.: US 8,523,609 B2
(45) Date of Patent: Sep. 3, 2013

(54) PHOTOVOLTAIC CONNECTOR ASSEMBLY

(75) Inventor: Paul David Roman, Jr., Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 99 days.

(21) Appl. No.: 13/158,856

(22) Filed: Jun. 13, 2011

(65) Prior Publication Data

US 2012/0312346 A1 Dec. 13, 2012

(51) Int. Cl.
*H01R 9/05* (2006.01)

(52) U.S. Cl.
USPC ..... 439/578

(58) Field of Classification Search
USPC ..... 439/455, 578, 274, 275
See application file for complete search history.

(56) References Cited

U.S. PATENT DOCUMENTS

| | | | | |
|---|---|---|---|---|
| 4,990,103 | A * | 2/1991 | Sazaki et al. | 439/455 |
| 7,448,894 | B2 * | 11/2008 | Tsuji et al. | 439/271 |
| 2010/0311269 | A1 | 12/2010 | Sattazahn et al. | |

FOREIGN PATENT DOCUMENTS

| | | | |
|---|---|---|---|
| DE | 40 24 188 | A1 | 2/1991 |
| EP | 2 249 439 | A2 | 11/2010 |
| WO | 97/07566 | A1 | 2/1997 |

OTHER PUBLICATIONS

International Search Report, International Application No. PCT/US2012/041843, International Filing Date, Nov. 6, 2012.

* cited by examiner

*Primary Examiner* — Phuong Dinh

(57) ABSTRACT

A photovoltaic connector assembly includes a housing that has a mating end and a cable end. The housing has a securing feature that is configured to secure the housing to another photovoltaic connector assembly. The housing has a cavity that extends between the mating end and the cable end. A terminal is received in the cavity. The terminal is configured to be mated to a corresponding terminal of the other photovoltaic connector assembly. The terminal is configured to be terminated to a cable. A cable locator is configured to be coupled to the cable rearward of the terminal. The cable locator has wings that extend from opposite sides of the cable locator. The cable locator is received in the cavity. The wings engage the housing to position the cable locator within the cavity.

20 Claims, 5 Drawing Sheets

PHOTOVOLTAIC CONNECTOR ASSEMBLY

BACKGROUND OF THE INVENTION

The subject matter herein relates generally to photovoltaic connector assemblies.

Photovoltaic (PV) modules or arrays produce electricity from solar energy. Electrical power produced by PV modules reduces the amount of energy required from non-renewable resources such as fossil fuels and nuclear energy. Significant environmental benefits are also realized from solar energy production, for example, reduction in air pollution from burning fossil fuels, reduction in water and land use from power generation plants, and reduction in the storage of waste byproducts. Solar energy produces no noise, and has few moving components. Because of their reliability, PV modules also reduce the cost of residential and commercial power to consumers.

PV cells are essentially large-area semiconductor diodes. Due to the photovoltaic effect, the energy of photons is converted into electrical power within a PV cell when the PV cell is irradiated by a light source such as sunlight. PV cells are typically interconnected into solar modules that have power ranges of up to 100 watts or greater. For large PV systems, special PV modules are produced with typical power range of up to several 100 W. A photovoltaic module is the basic element of a photovoltaic power generation system. A PV module has many solar cells interconnected in series or parallel, according to the desired voltage and current parameters. PV cells are connected and placed between a polyvinyl plate on the bottom and a tempered glass on the top. PV cells are interconnected with thin contacts on the upper side of the semiconductor material. The typical crystalline modules power ranges from several W to up to 200 W/module.

In the case of facade or roof systems, the photovoltaic system may be installed during construction, or added to the building after it is built. Roof systems are generally lower powered systems, e.g., 10 kW, to meet typical residential loads. Roof integrated photovoltaic systems may consist of different module types, such as crystalline and micro-perforated amorphous modules. Roof-integrated photovoltaic systems are integrated into the roof; such that the entire roof or a portion thereof is covered with photovoltaic modules, or they are added to the roof later. PV cells may be integrated with roof tiles or shingles.

PV modules/arrays require specially designed devices adapted for interconnecting the various PV modules/arrays with each other, and with electrical power distribution systems. PV connection systems are used to accommodate serial and parallel connection of PV arrays. In addition to connection boxes, a PV connection system includes connectors that allow for speedy field installation or high-speed manufacture of made-to-length cable assemblies. Connection or connection boxes may be required to receive specialized cable terminations from PV modules/arrays, with power diodes inside for controlling current flow to the load. PV arrays may be required in areas with tight space restraints and requirements, requiring the size of the PV module to be minimized.

What is needed is a photovoltaic connector assembly for a photovoltaic solar array panel that satisfies one or more of these space constraint needs or provides other advantageous features.

BRIEF DESCRIPTION OF THE INVENTION

In one embodiment, a photovoltaic connector assembly is provided having a housing that has a mating end and a cable end. The housing has a securing feature that is configured to secure the housing to another photovoltaic connector assembly. The housing has a cavity that extends between the mating end and the cable end. A terminal is received in the cavity. The terminal is configured to be mated to a corresponding terminal of the other photovoltaic connector assembly. The terminal is configured to be terminated to a cable. A cable locator is configured to be coupled to the cable rearward of the terminal. The cable locator has wings that extend from opposite sides of the cable locator. The cable locator is received in the cavity. The wings engage the housing to position the cable locator within the cavity.

In another embodiment, a photovoltaic connector assembly is provided having a housing that has a mating end and a cable end. The housing has a securing feature that is configured to secure the housing to another photovoltaic connector assembly. The housing has a cavity that extends between the mating end and the cable end. A terminal is received in the cavity. The terminal is configured to be mated to a corresponding terminal of the other photovoltaic connector assembly. The terminal is configured to be terminated to a cable. The terminal is one of a blade terminal or a blade receptacle terminal that has a generally wide and short configuration. A cable locator is configured to be coupled to the cable rearward of the terminal. The cable locator has wings that extend from opposite sides of the cable locator. The cable locator is received in the cavity. The wings engage the housing to position the cable locator within the cavity.

In a further embodiment, a photovoltaic system is provided including a first solar shingle and a second solar shingle that are configured to be mounted to a substrate. The second solar shingle overlaps a top portion of the first solar shingle such that an overhang space is created immediately above a top edge of the first solar shingle. The overhang space is defined between a base of the second solar shingle, the top edge of the first solar shingle and the substrate. A low profile photovoltaic connector assembly is received in the overhang space. The photovoltaic connector assembly is cable mounted to a cable. The cable is routed through the overhang space.

BRIEF DESCRIPTION OF THE DRAWINGS

FIG. 2 is a side view of a portion of the PV system shown in

FIG. 1.

DETAILED DESCRIPTION OF THE INVENTION

Figure 1:
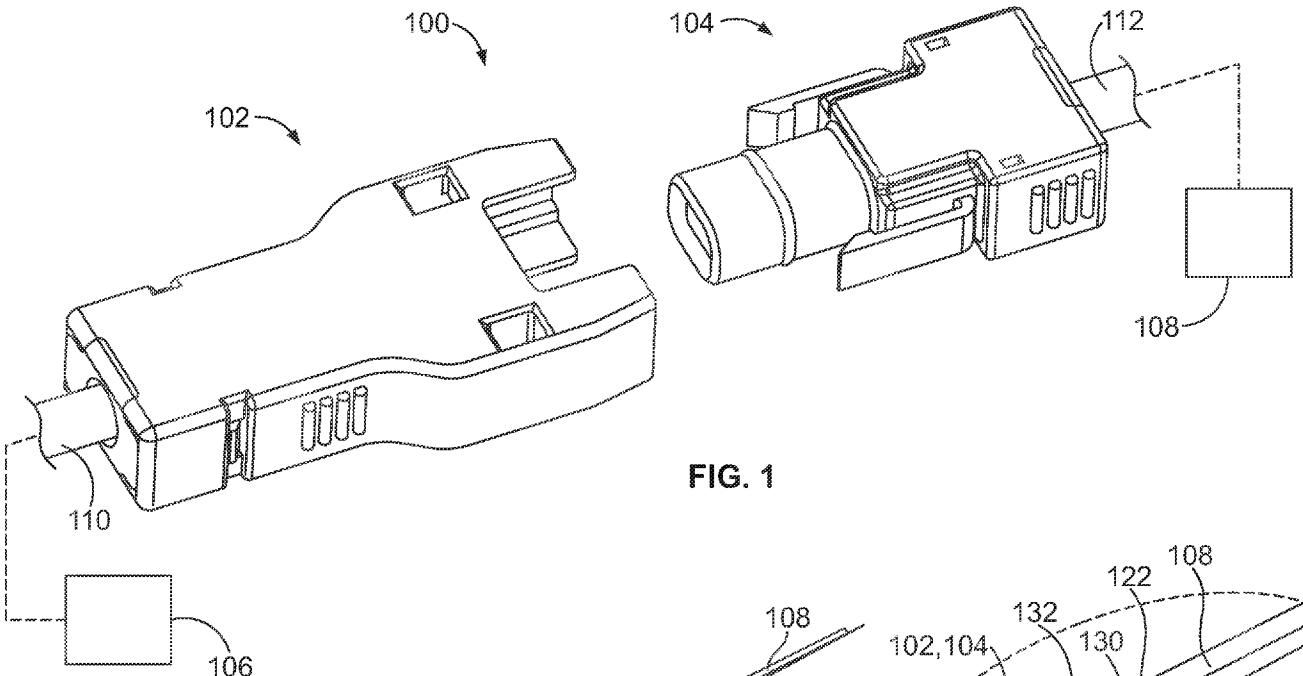
FIG. 1 illustrates a photovoltaic (PV) system formed in accordance with an exemplary embodiment.

FIG. 1 illustrates a photovoltaic (PV) system 100 formed in accordance with an exemplary embodiment. The PV system 100 includes first and second PV connector assemblies 102, 104 that are configured to be mated to connect first and second PV components 106, 108. In the illustrated embodiment, the PV connector assemblies 102, 104 are cable mounted connector assemblies terminated to ends of cables 110, 112, respectively. The cables 110, 112 are terminated to the PV components 106, 108. The PV components 106, 108 may be any type of PV components, such as PV modules or arrays that are used to generate electricity, such as solar panels, or other PV components used within the PV system 100 such as power storage devices, sensors, controllers, and the like. In an exemplary embodiment, the PV components 106, 108 are solar shingles that may be coupled to a roof of a building.

The PV connector assemblies 102, 104 may be coupled together to transmit power and/or data along the transmission path between the PV components 106, 108. In the illustrated embodiment, the first PV connector assembly 102 constitutes a plug assembly and the second PV connector assembly 104 constitutes a receptacle assembly that is configured to receive the plug assembly. In an exemplary embodiment, the PV connector assemblies 102, 104 are low profile connector assemblies that have a short and wide configuration such that the PV connector assemblies 102, 104 have a larger side-to-side dimension as compared to a top-to-bottom dimension. In the illustrated embodiment, the PV connector assemblies 102, 104 have a height that is not much taller than a diameter of the cables 110, 112.

The low profile aspect of the PV connector assemblies 102, 104 allow the PV connector assemblies 102, 104 to be positioned within, and routed through, small spaces in which the PV system is utilized.

Figure 2:
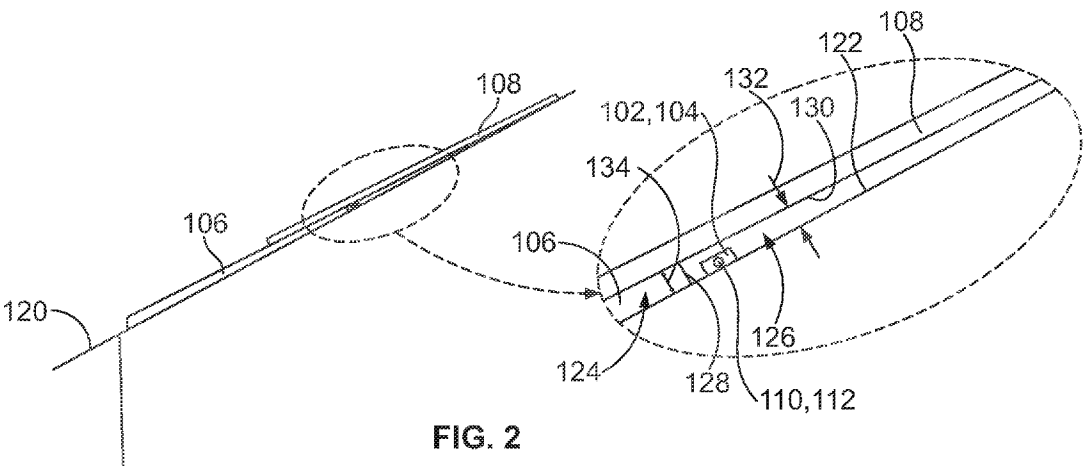

FIG. 2 is a side view of a portion of the PV system 100. FIG. 2 shows the first and second PV components 106, 108 as solar shingles mounted to a roof 120 of a building. The roof 120 defines a substrate 122 on which the PV components 106, 108 are mounted. The first PV component 106 constitutes a first solar shingle, and may be referred to hereafter as a first solar shingle 106. The second PV component 108 constitutes a second solar shingle, and may be referred to hereafter as a second solar shingle 108.

The second solar shingle 108 overlaps a top portion 124 of the first solar shingle 106 such that an overhang space 126 is created immediately above a top edge 128 of the first solar shingle 106. The overhang space 126 is defined between a base 130 of the second solar shingle 108, the top edge 128 of the first solar shingle 106 and the substrate 122. The base 130 of the second solar shingle 108 is angled downward toward the substrate 122 from the top edge 128 of the first solar shingle 106 such that the overhang space 126 decreases in height between the base 130 and the substrate 122. The largest height 132 of the overhang space 126 is immediately adjacent the top edge 128, and the height decreases as you travel away from the top edge 128. The height 132 is less than or equal to a thickness 134 of the first solar shingle 106.

The PV connector assemblies 102, 104 and the cables 110, 112 are configured to be routed through the overhang space 126. The low profile of the PV connector assemblies 102, 104 allow the PV connector assemblies 102, 104 to fit into the overhang space 126. In an exemplary embodiment, the PV connector assemblies 102, 104 are less than 10 mm tall in order to fit within the overhang space 126.

Figure 3:
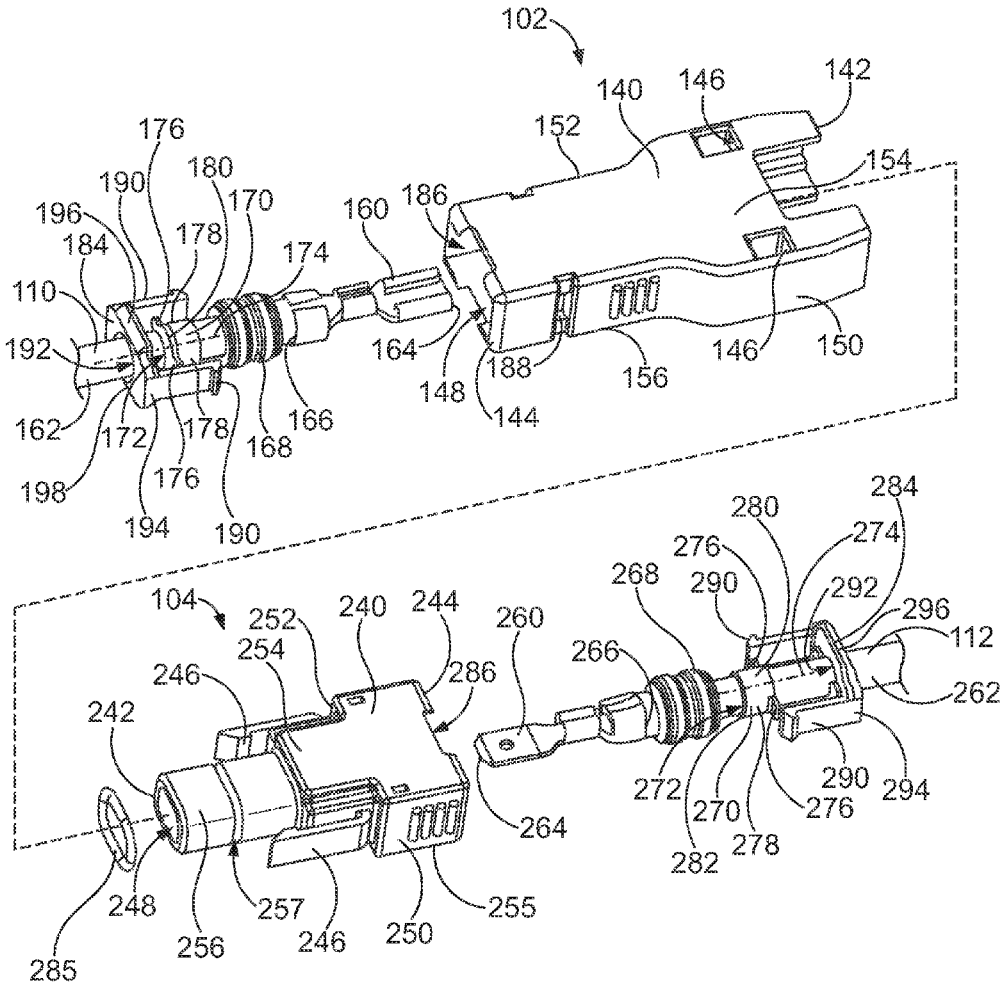
FIG. 3 is an exploded view of the PV connector assemblies.

FIG. 3 is an exploded view of the PV connector assemblies 102, 104. The first PV connector assembly 102 includes a housing 140 extending between a mating end 142 and a cable end 144. The housing 140 has a securing feature 146 configured to secure the housing 140 to the second PV connector assembly 104. The housing 140 has a cavity 148 extending between the mating end 142 and the cable end 144. The housing 140 has opposite sides 150, 152 extending between a top 154 and a bottom 156. The housing 140 has a low profile such that the distance between the top and bottom 154, 156 is minimized. Optionally, the top and bottom 154, 156 may be planar and parallel to one another. In an exemplary embodiment, the housing 140 is wider from side-to-side 150, 152 than from top-to-bottom 154, 156.

The first PV connector assembly 102 includes a terminal 160 terminated to a center conductor of the cable 110. In an exemplary embodiment, the terminal 160 is crimped to the center conductor and to a jacket 162 of the cable 110. In the illustrated embodiment, the terminal 160 constitutes a blade receptacle terminal having a generally wide and short configuration such that the terminal 160 is wider side-to-side than top-to-bottom. Edges of the blade receptacle terminal 160 are folded over to define a receptacle configured to receive a terminal of the second PV connector assembly 104. In an exemplary embodiment, the terminal 160 constitutes a Faston® tab, however other types of terminals are possible in alternative embodiments. For example, the terminal may be a pin or a socket terminal, such as the terminal 460 shown in FIG. 6, or another type of mating contact. Having the terminal 160 relatively short top-to-bottom, allows the low profile aspect of the PV connector assembly 102 may be maintained. For example, the blade receptacle type terminal may have less height as compared to a conventional pin and socket type terminal, which allows the housing 140, that holds the terminal 160, to have a reduced height making the PV connector assembly 102 low profile.

The terminal 160 has a mating end 164 and a cable end 166. The cable end 166 is configured to be crimped to the jacket 162. In an exemplary embodiment, the cable end 166 may be crimped to a seal 168 in addition to the jacket 162 of the cable 110.

The seal 168 extends around the jacket 162 of the cable 110. The seal 168 is configured to be received in the cavity 148 of the housing 140 to seal against the housing 140. The seal 168 also seals against the cable 110. Optionally, the seal 168 may be a silicon seal. Other types of seals are possible in alternative embodiments. In an exemplary embodiment, the seal 168 prevents movement of the cable 110 by a stiction force created between the seal 168 and the jacket 162. The seal 168 provides strain relief between the cable 110 and the PV connector assembly 102.

The PV connector assembly 102 includes a cable locator 170 coupled to the cable 110. Optionally, the cable locator 170 may be crimped to the cable 110 rearward of the seal 168. The cable locator 170 is coupled to the cable 110 at a predetermined distance from the mating end 164 of the terminal 160. The cable locator 170 is received in the cavity 148 of the housing 140. The cable locator 170 is held in position with respect to the housing 140 to position the cable 110 and/or the terminal 160 with respect to the housing 140. For example, the cable locator 170 may axially position the mating end 164 with respect to the housing 140. Alternatively, a portion of the terminal 160 may engage the housing 140 to locate the terminal 160 with respect to the housing 140.

The cable locator 170 includes a central bore 172 extending therethrough along a bore axis 174. The cable locator 170 receives the cable 110 in the central bore 172, and the cable 110 extends along the bore axis 174.

The cable locator 170 includes wings 176 extending from opposite sides 178 of the cable locator 170. In an exemplary embodiment, the wings 176 extend radially outward from the cable locator 170 generally perpendicular with respect to the bore axis 174. The wings 176 do not extend from a top 180 or a bottom 182 of the cable locator 170. As such, the wings 176 do not add to the overall top-to-bottom height of the cable locator 170. By only extending from the sides 178, the cable locator 170 has a low profile and allows the housing 140 to have a low profile. The wings 176 have forward facing surfaces and rear facing surfaces opposite the forward facing surfaces. In an exemplary embodiment, when the cable locator 170 is loaded into the housing 140, the forward facing surfaces of the wings 176 may engage a wall or shoulder or other portions of the housing 140 to position the cable locator 170 within the cavity 148.

The PV connector assembly 102 includes a cap 184 extending around the cable 110. For example, the cable 110 extends through a bore 192 extending through the cap 184. The cap 184 is positioned rearward of the cable locator 170. The cap 184 is configured to be coupled to the housing 140. In an exemplary embodiment, the cap 184 engages the back of the cable locator 170 within the housing 140 to hold the cable locator 170 in the cavity 148. For example, the cap 184 may engage the rear facing surfaces of the wings 176 such that the wings 176 are captured between the housing 140 and the cap 184.

In an exemplary embodiment, the housing 140 has an opening 186 at the cable end 144. The housing 140 has one or more latching features 188 proximate to the cable end 144. The cap 184 is received in the opening 186 of the housing 140. The cap 184 has one or more latching features 190 that engage the latching features 188 of the housing 140 to secure the cap 184 to the housing 140. In the illustrated embodiment, the latching features 188 constitute receptacles and/or catch surfaces that are engaged by the latching features 190. The latching features 190 constitute forward extending latches that are configured to engage the latching features 188. The latching features 190 are deflectable during loading of the cap 184 into the cavity 148 and the latching features 190 snap into place in engagement with the latching features 188 to hold the cap 184 within the housing 140.

In an exemplary embodiment, the latching features 190 are provided along sides 194 of the cap 184. The latching features 190 do not extend above the top 196 or below the bottom 198. As such, the latching features 190 add to the side-to-side width of the cap 184, but do not affect the top-to-bottom height of the cap 184. Such arrangement of the latching features 190 aids in maintaining the low profile configuration of the PV connector assembly 102. Optionally, the top 196 may be flush with the top 154, and the bottom 198 may be flush with the bottom 156.

The second PV connector assembly 104 includes a housing 240 extending between a mating end 242 and a cable end 244. The housing 240 has a securing feature 246 configured to secure the housing 240 to the first PV connector assembly 102. The housing 240 has a cavity 248 extending between the mating end 242 and the cable end 244. The housing 240 has opposite sides 250, 252 that extend between a top 254 and a bottom 255. The housing 240 has a low profile such that the distance between the top and bottom 254, 255 is minimized. Optionally, the top and bottom 254, 255 may be planar and parallel to one another. In an exemplary embodiment, the housing 240 is wider from side-to-side 250, 252 than from top-to-bottom 254, 255.

The housing 240 has an embossment 256 at the mating end 242. The embossment 256 is forward extending and has a reduced height and width as compared to other portions of the housing 240. The embossment 256 is configured to be received in the cavity 148 of the housing 140. In an exemplary embodiment, the embossment 256 has a circumferential channel 257 extending around the embossment 256. A gasket 258 is received in the channel 257 and provides sealing between the housing 240 and the housing 140 when the PV connector assemblies 102, 104 are mated.

The second PV connector assembly 104 includes a terminal 260 terminated to a center conductor of the cable 112. In an exemplary embodiment, the terminal 260 is crimped to the center conductor and to a jacket 262 of the cable 112. In the illustrated embodiment, the terminal 260 constitutes a blade terminal having a generally wide and short configuration such that the terminal 260 is wider side-to-side than top-to-bottom. The blade terminal 260 is configured to be receiving in the blade receptacle terminal 160 of the first PV connector assembly 102. In an exemplary embodiment, the terminal 260 constitutes a Faston® tab, however other types of terminals are possible in alternative embodiments. For example, the terminal may be a socket or a pin, such as the terminal 462 shown in FIG. 6, or another type of mating contact. Having the terminal 260 relatively short top-to-bottom, allows the low profile aspect of the PV connector assembly 104 may be maintained. For example, the blade type terminal may have less height as compared to a conventional pin and socket type terminal, which allows the housing 240, that holds the terminal 260, to have a reduced height making the PV connector assembly 104 low profile.

The terminal 260 has a mating end 264 and a cable end 266. The cable end 266 is configured to be crimped to the jacket 262. In an exemplary embodiment, the cable end 266 may be crimped to a seal 268 in addition to the jacket 262 of the cable 112.

The seal 268 extends around the jacket 262 of the cable 112. The seal 268 is configured to be received in the cavity 248 of the housing 240 to seal against the housing 240. The seal 268 also seals against the cable 112. Optionally, the seal 268 may be a silicon seal. Other types of seals are possible in alternative embodiments. In an exemplary embodiment, the seal 268 prevents movement of the cable 112 by a stiction force created between the seal 268 and the jacket 262. The seal 268 provides strain relief between the cable 112 and the PV connector assembly 104.

The PV connector assembly 104 includes a cable locator 270 coupled to the cable 112. Optionally, the cable locator 270 may be crimped to the cable 112 rearward of the seal 268. The cable locator 270 is coupled to the cable 112 at a predetermined distance from the mating end 264 of the terminal 260. The cable locator 270 is received in the cavity 248 of the housing 240. The cable locator 270 is held in position with respect to the housing 240 to position the cable 112 and/or the terminal 260 with respect to the housing 240. For example, the cable locator 270 may axially position the mating end 264 with respect to the housing 240. Alternatively, a portion of the terminal 260 may engage the housing 240 to locate the terminal 260 with respect to the housing 240.

The cable locator 270 includes a central bore 272 extending therethrough along a bore axis 274. The cable locator 270 receives the cable 112 in the central bore 272, and the cable 112 extends along the bore axis 274.

The cable locator 270 includes wings 276 extending from opposite sides 278 of the cable locator 270. In an exemplary embodiment, the wings 276 extend radially outward from the cable locator 270 generally perpendicular with respect to the bore axis 274. The wings 276 do not extend from a top 280 or a bottom 282 of the cable locator 270. As such, the wings 276 do not add to the overall top-to-bottom height of the cable locator 270. By only extending from the sides 278, the cable locator 270 has a low profile and allows the housing 240 to have a low profile. The wings 276 have forward facing surfaces and rear facing surfaces opposite the forward facing surfaces. In an exemplary embodiment, when the cable locator 270 is loaded into the housing 240, the forward facing surfaces of the wings 276 may engage a wall or shoulder or other portions of the housing 240 to position the cable locator 270 within the cavity 248.

The PV connector assembly 104 includes a cap 284 extending around the cable 112. For example, the cable 112 extends through a bore 292 extending through the cap 284. The cap 284 is positioned rearward of the cable locator 270. The cap 284 is configured to be coupled to the housing 240. In an exemplary embodiment, the cap 284 engages the back of the cable locator 270 within the housing 240 to hold the cable locator 270 in the cavity 248. For example, the cap 284 may engage the rear facing surfaces of the wings 276 such that the wings 276 are captured between the housing 240 and the cap 284.

In an exemplary embodiment, the housing 240 has an opening 286 at the cable end 244. The housing 240 has one or more latching features 288 proximate to the cable end 244. The cap 284 is received in the opening 286 of the housing 240. The cap 284 has one or more latching features 290 that engage the latching features 288 of the housing 240 to secure the cap 284 to the housing 240. In the illustrated embodiment, the latching features 288 constitute receptacles and/or catch surfaces that are engaged by the latching features 290. The latching features 290 constitute forward extending latches that are configured to engage the latching features 288. The latching features 290 are deflectable during loading of the cap 284 into the cavity 248 and the latching features 290 snap into place in engagement with the latching features 288 to hold the cap 284 within the housing 240.

In an exemplary embodiment, the latching features 290 are provided along sides 294 of the cap 284. The latching features 290 do not extend above the top 296 or below the bottom 298. As such, the latching features 290 add to the side-to-side width of the cap 284, but do not affect the top-to-bottom height of the cap 284. Such arrangement of the latching features 290 aids in maintaining the low profile configuration of the PV connector assembly 104. Optionally, the top 296 may be flush with the top 254, and the bottom 298 may be flush with the bottom 256.

Figure 4:
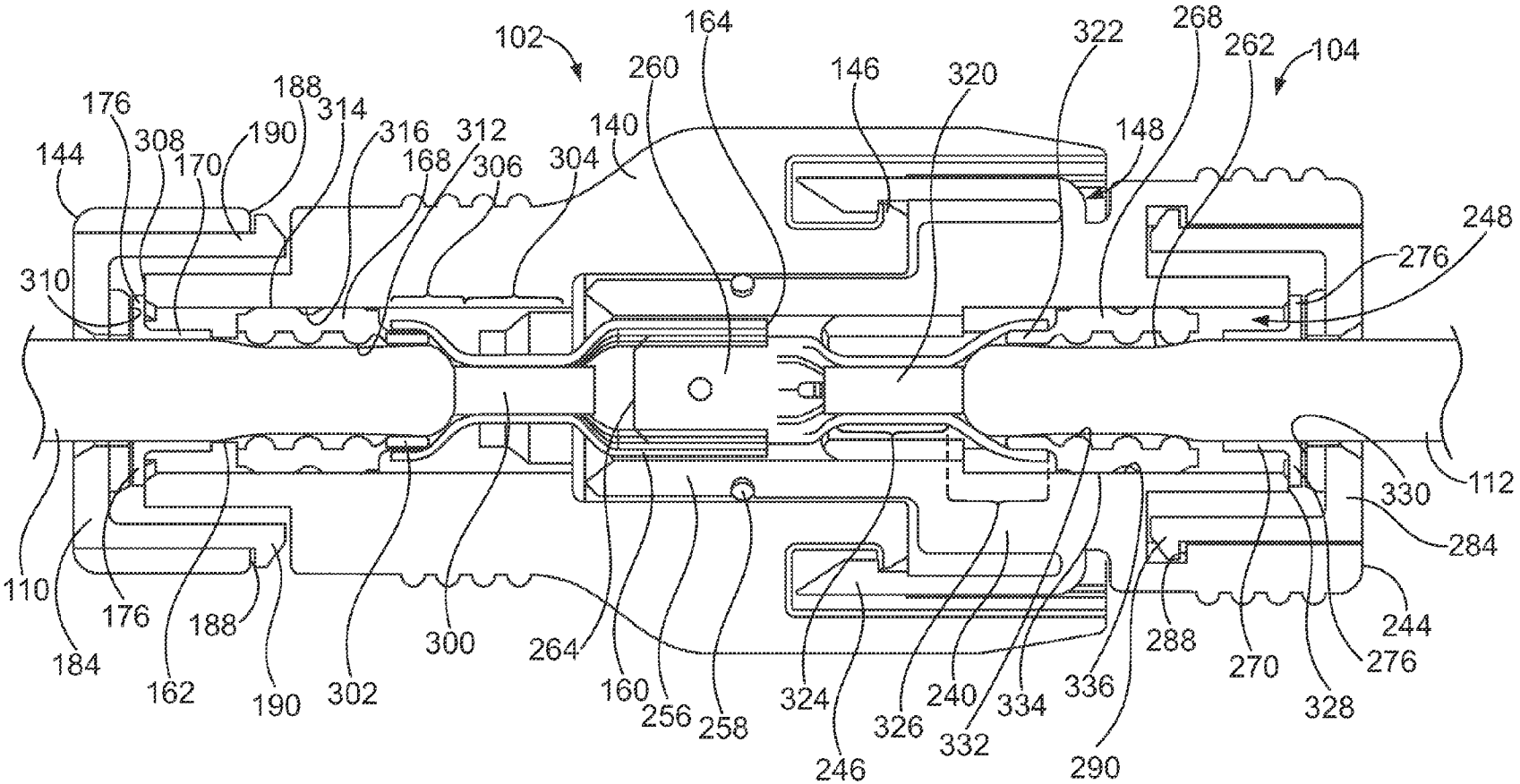
FIG. 4 is a cross sectional view of the PV connector assemblies in a mated or assembled state.
Figure 5:
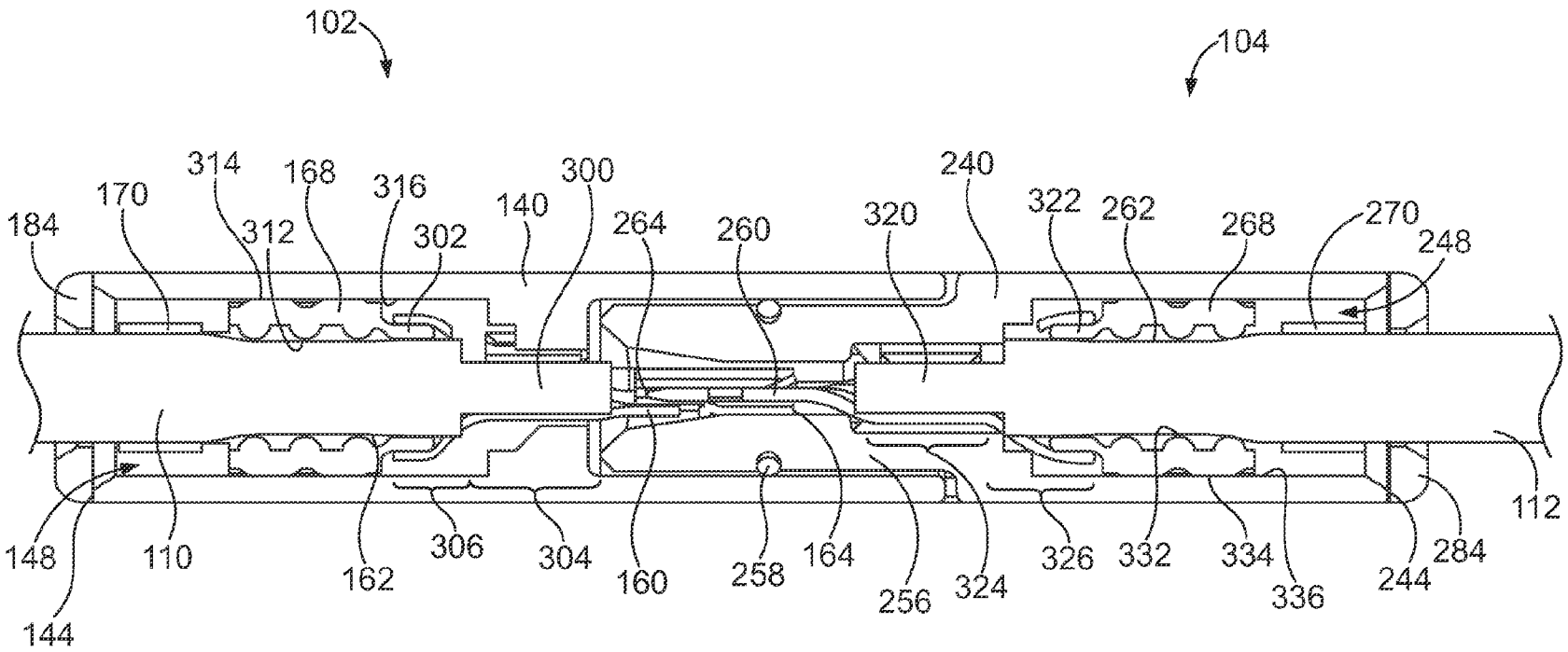
FIG. 5 is another cross sectional view of the PV connector assemblies in the mated or assembled state.

FIGS. 4 and 5 are horizontal and vertical cross sections, respectively, of the PV connector assemblies 102, 104 in a mated or assembled state. During assembly, the seal 168, cable locator 170 and cap 184 are loaded onto the end of the cable 110. The end of the cable 110 is stripped exposing a center conductor 300 of the cable 110. The seal 168 is position proximate to the end of the jacket 162. A front extension 302 of the seal 168 extends forward from the seal 168. The front extension 302 at least partially circumferentially surrounds the jacket 162. Once the seal 168 is positioned on the cable 110, the terminal 160 is crimped to the cable 110. A conductor portion 304 of the terminal 160 is crimped to the center conductor 300. A jacket portion 306 of the terminal 160 is crimped to the jacket 162 and the front extension 302. Crimping the jacket portion 306 to the front extension 302 holds the seal 168 axially along the cable 110. Crimping the front extension 302 also compresses the front extension 302 of the seal 168 against the jacket 162 to provide additional sealing between the seal 168 and the jacket 162.

In an exemplary embodiment, the cable locator 170 may be crimped to the cable 110 to secure the axial position of the cable locator 170 on the cable 110. The cable locator 170 may be secured to the cable 110 by other means in alternative embodiments. The cable locator 170 is positioned rearward of the seal 168.

After the terminal 160 and cable locator 170 are crimped to the cable 110, the cable 110, along with the terminal 160, seal 168, cable locator 170 are loaded into the cavity 148 through the cable end 144 as a subassembly. The subassembly is loaded into the housing 140 until the wings 176 engage an inner wall 308 of the housing 140 (shown in FIG. 4). The cable locator 170 defines a loading stop for the cable 110 limiting loading of the cable 110 beyond a predetermined position. When the wings 176 engage the inner wall 308, the mating end 164 of the terminal 160 is positioned at a predetermined location within the housing 140 for mating with the terminal 160.

The cap 184 is loaded into the housing 140 to hold the cable locator 170 in the housing 140. The cap 184 may be loaded with the subassembly as part of the subassembly or may be loaded after the subassembly is positioned in the housing 140. The latching features 190 engage the latching features 188 to lock the cap 184 in the housing 140. A blocking wall 310 of the cap 184 is positioned immediately behind the cable locator 170 to resist rearward movement of the cable locator 170. The cable locator 170 is captured between the blocking wall 310 and the inner wall 308.

When the PV connector assembly 102 is assembled, the seal 168 provides sealing between the seal 168 and the cable 110, and also provides sealing between the seal 168 and the housing 140. The seal 168 has an inner sealing surface 312 and an outer sealing surface 314. The inner sealing surface 312 engages and provides a seal along the cable 110. The outer sealing surface 314 engages and provides a seal along cavity walls 316 of the housing 140. The seal 168 is generally held within the housing 140 by stiction between the outer sealing surface 314 and the cavity walls 316. The seal 168 is generally held in place with respect to the cable 110 by stiction created between the inner sealing surface 312 and the jacket 162. The seal 168 is also held in place with respect to the cable 110 by the crimp of the terminal 160 around the front extension 302.

During assembly, the seal 268, cable locator 270 and cap 284 are loaded onto the end of the cable 112. The end of the cable 112 is stripped exposing a center conductor 320 of the cable 112. The seal 268 is position proximate to the end of the jacket 262. A front extension 322 of the seal 268 extends forward from the seal 268. The front extension 322 at least partially circumferentially surrounds the jacket 262. Once the seal 268 is positioned on the cable 112, the terminal 260 is crimped to the cable 112. A conductor portion 324 of the terminal 260 is crimped to the center conductor 320. A jacket portion 326 of the terminal 260 is crimped to the jacket 262 and the front extension 322. Crimping the jacket portion 326 to the front extension 322 holds the seal 268 axially along the cable 112. Crimping the front extension 322 also compresses the front extension 322 of the seal 268 against the jacket 262 to provide additional sealing between the seal 268 and the jacket 262.

In an exemplary embodiment, the cable locator 270 may be crimped to the cable 112 to secure the axial position of the cable locator 270 on the cable 112. The cable locator 270 may be secured to the cable 112 by other means in alternative embodiments. The cable locator 270 is positioned rearward of the seal 268.

After the terminal 260 and cable locator 270 are crimped to the cable 112, the cable 112, along with the terminal 260, seal 268, cable locator 270 are loaded into the cavity 248 through the cable end 244 as a subassembly. The subassembly is loaded into the housing 240 until the wings 276 engage an inner wall 328 of the housing 240 (shown in FIG. 4). The cable locator 270 defines a loading stop for the cable 112 limiting loading of the cable 112 beyond a predetermined position. When the wings 276 engage the inner wall 328, the mating end 264 of the terminal 260 is positioned at a predetermined location within the housing 240 for mating with the terminal 260.

The cap 284 is loaded into the housing 240 to hold the cable locator 270 in the housing 240. The cap 284 may be loaded with the subassembly as part of the subassembly or may be loaded after the subassembly is positioned in the housing 240.

The latching features 290 engage the latching features 288 to lock the cap 284 in the housing 240. A blocking wall 330 of the cap 284 is positioned immediately behind the cable locator 270 to resist rearward movement of the cable locator 270. The cable locator 270 is captured between the blocking wall 330 and the inner wall 328.

When the PV connector assembly 104 is assembled, the seal 268 provides sealing between the seal 268 and the cable 112, and also provides sealing between the seal 268 and the housing 240. The seal 268 has an inner sealing surface 332 and an outer sealing surface 334. The inner sealing surface 332 engages and provides a seal along the cable 112. The outer sealing surface 334 engages and provides a seal along cavity walls 336 of the housing 240. The seal 268 is generally held within the housing 240 by stiction between the outer sealing surface 334 and the cavity walls 336. The seal 268 is generally held in place with respect to the cable 112 by stiction created between the inner sealing surface 332 and the jacket 262. The seal 268 is also held in place with respect to the cable 112 by the crimp of the terminal 260 around the front extension 322.

When the first and second PV connector assemblies 102, 104 are mated together, the embossment 256 is received in the cavity 148. The gasket 258 provides a seal between the housing 140 and the housing 240. The securing features 146 of the housing 140 engage the securing features 246 of the housing 240 (shown in FIG. 4) to secure the PV connector assemblies 102, 104 to one another. In the illustrated embodiment, the securing feature 146 is defined by receptacles and/or catch surfaces and the securing features 246 are defined by latches that engage the catch surfaces.

When the first and second PV connector assemblies 102, 104 are mated, the terminal 260 is electrically connected to the terminal 160. For example, the blade of the terminal 260 is received in the blade receptacle of the terminal 160. Because the terminals 160, 260 have a wide and short configuration, the electrical interface between the PV connectors assemblies 102, 104 has a low profile, allowing the housing 140, 240 to have a low profile. Having wide terminals 160, 260 also provides a large surface area on the terminals 160, 260 at the mating interfaces to allow voltage or current to be transmitted between the PV connector assemblies 102, 104.

Having the various components of the PV connector assemblies 102, 104 sacrificially elongated in the width direction (e.g. side-to-side) as opposed to the height direction (e.g. top-to-bottom), such as the terminals 160, 260, the securing features 146, 246, the wings 176, 276, the latching features 188, 190, 288, 290 and the like, the PV connector assemblies 102, 104 are able to maintain a low profile. The low profile allows the PV connector assemblies 102, 104 to fit in tight spaces, such as the overhang space between two solar shingles.

Figure 6:
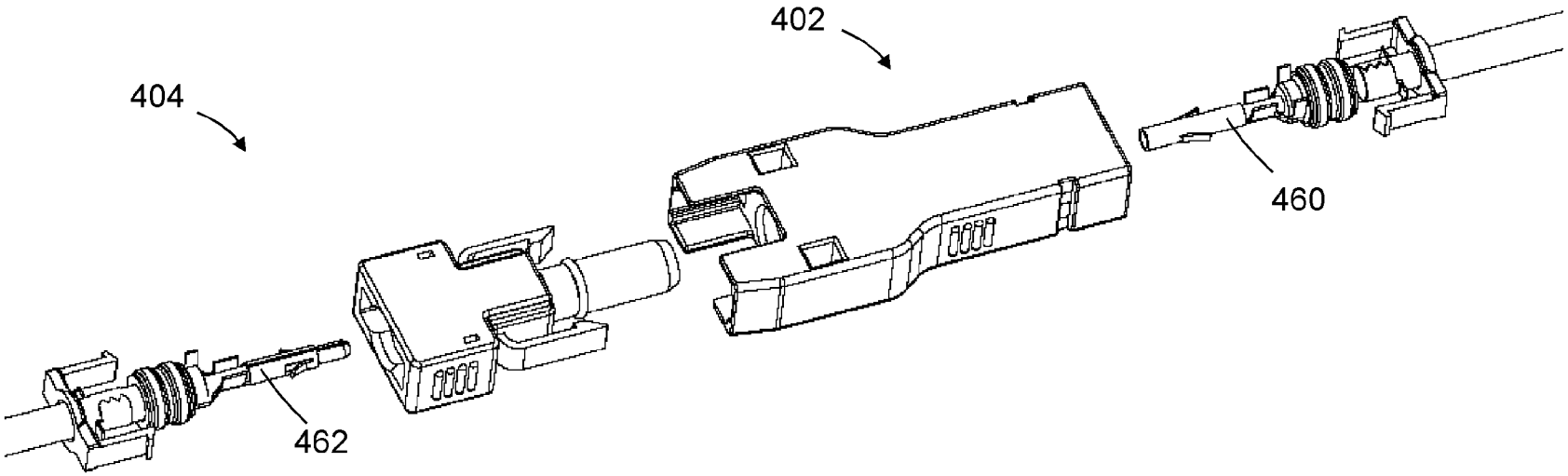
FIG. 6 is an exploded view of PV connector assemblies.

FIG. 6 illustrates alternative PV connector assemblies 402, 404 having different types of terminals 460, 462. For example, in the illustrated embodiment, the terminals 460, 462 constitute socket and pin terminals. The terminals 460, 462 have small diameters, such as diameters that are less than the diameter of the cables.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A photovoltaic connector assembly comprising:

a housing having a mating end and a cable end, the housing having a securing feature configured to secure the housing to another photovoltaic connector assembly, the housing having a cavity extending between the mating end and the cable end;

a terminal received in the cavity, the terminal being configured to be mated to a corresponding terminal of the other photovoltaic connector assembly, the terminal being configured to be terminated to a cable;

a cable locator configured to be coupled to the cable rearward of the terminal, the cable locator having wings extending from opposite sides of the cable locator, the cable locator being received in the cavity, the wings engaging the housing to position the cable locator within the cavity; and a cap coupled to the cable end of the housing, the cap engaging the wings to capture the cable locator between the cap and a portion of the housing.

2. The photovoltaic connector assembly of claim 1, wherein the cap includes latching features being received inside the cavity and being secured to the housing to secure the cap to a portion of the housing.

3. The photovoltaic connector assembly of claim 1, wherein the wings extend from the opposite sides of the cable locator such that the cable locator is wider from side-to-side and shorter from top-to-bottom.

4. The photovoltaic connector assembly of claim 1, wherein the cable locator includes a central bore extending along a bore axis, the cable locator receiving the cable in the central bore, the wings extending radially outward from the cable locator generally perpendicular to the bore axis.

5. The photovoltaic connector assembly of claim 1, wherein the cable locator is configured to be crimped to the cable to secure the axial position of the cable locator with respect to the cable and the terminal.

6. The photovoltaic connector assembly of claim 1, further comprising a seal having an inner sealing surface and an outer sealing surface, the inner sealing surface being configured to engage and provide a seal along the cable, the outer sealing surface engaging and providing a seal along walls of the housing defining the cavity.

7. The photovoltaic connector assembly of claim 1, further comprising a seal having an inner sealing surface and an outer sealing surface, the inner sealing surface being configured to engage and provide a seal along the cable, the outer sealing surface engaging and providing a seal along walls of the housing defining the cavity, the seal having a front extension extending forward along the cable, the terminal being crimped around the extension and a jacket of the cable to secure the position of the seal with respect to the terminal.

8. The photovoltaic connector assembly of claim 1, wherein the terminal is one of a blade terminal or a blade receptacle terminal having a generally wide and short configuration.

9. The photovoltaic connector assembly of claim 1, wherein the housing has an opening at the cable end, the housing having latching features proximate to the cable end, the cap being received in the opening of the housing, the cap having latching features engaging the latching features of the housing to secure the cap to the housing, the cap engaging the cable locator within the housing to hold the cable locator in the cavity.

10. The photovoltaic connector assembly of claim 1, wherein the housing has a generally wide and short configuration defining a low profile housing configured to be received in an overhang space between two solar shingles.

11. A photovoltaic connector assembly comprising:

a housing having a mating end and a cable end, the housing having a securing feature configured to secure the housing to another photovoltaic connector assembly, the housing having a cavity extending between the mating end and the cable end;

a terminal received in the cavity, the terminal being configured to be mated to a corresponding terminal of the other photovoltaic connector assembly, the terminal being configured to be terminated to a cable, the terminal being one of a blade terminal or a blade receptacle terminal having a generally wide and short configuration; and a cable locator configured to be coupled to the cable rearward of the terminal, the cable locator having wings extending from opposite sides of the cable locator, the cable locator being received in the cavity, the wings engaging the housing to position the cable locator within the cavity; and a cap coupled to the cable end of the housing, the cap engaging the wings to capture the cable locator between the cap and a portion of the housing.

12. The photovoltaic connector assembly of claim 11, wherein the cap includes latching features being received inside the cavity and being secured to the housing to secure the cap to a portion of the housing.

13. The photovoltaic connector assembly of claim 11, wherein the wings extend from the opposite sides of the cable locator such that the cable locator is wider from side-to-side and shorter from top-to-bottom.

14. The photovoltaic connector assembly of claim 11, wherein the cable locator includes a central bore extending along a bore axis, the cable locator receiving the cable in the central bore, the wings extending radially outward from the cable locator generally perpendicular to the bore axis.

15. The photovoltaic connector assembly of claim 11, further comprising a seal having an inner sealing surface and an outer sealing surface, the inner sealing surface being configured to engage and provide a seal along the cable, the outer sealing surface engaging and providing a seal along walls of the housing defining the cavity, the seal having a front extension extending forward along the cable, the terminal being crimped around the extension and a jacket of the cable to secure the position of the seal with respect to the terminal.

16. The photovoltaic connector assembly of claim 11, wherein the housing has an opening at the cable end, the housing having latching features proximate to the cable end, the photovoltaic connector assembly further comprising a cap having a cable bore configured to receive the cable, the cap being received in the opening of the housing, the cap having latching features engaging the latching features of the housing to secure the cap to the housing, the cap engaging the cable locator within the housing to hold the cable locator in the cavity.

17. The photovoltaic connector assembly of claim 11, wherein the housing has a generally wide and short configuration defining a low profile housing configured to be received in an overhang space between two solar shingles.

18. A photovoltaic system comprising:

a first solar shingle and a second solar shingle configured to be mounted to a substrate, the second solar shingle overlapping a top portion of the first solar shingle such that an overhang space is created immediately above a top edge of the first solar shingle, the overhang space being defined between a base of the second solar shingle, the top edge of the first solar shingle and the substrate; and a low profile photovoltaic connector assembly received in the overhang space, the photovoltaic connector assembly being cable mounted to a cable, the cable being routed through the overhang space, the low profile photovoltaic connector assembly comprising:

a housing having a mating end and a cable end, the housing having a securing feature configured to secure the housing to another photovoltaic connector assembly, the housing having a cavity extending between the mating end and the cable end;

a terminal received in the cavity, the terminal being configured to be mated to a corresponding terminal of the other photovoltaic connector assembly, the terminal being configured to be terminated to a cable;

a cable locator configured to be coupled to the cable rearward of the terminal, the cable locator having wings extending from opposite sides of the cable locator, the cable locator being received in the cavity, the wings engaging the housing to position the cable locator within the cavity; and a cap coupled to the cable end of the housing, the cap engaging the wings to capture the cable locator between the cap and a portion of the housing.

19. The photovoltaic system of claim 18, wherein the cap includes latching features being received inside the cavity and being secured to the housing to secure the cap to a portion of the housing.

20. The photovoltaic system of claim 18, wherein the wings extend from the opposite sides of the cable locator such that the cable locator is wider from side-to-side and shorter from top-to-bottom.

* * * * *